US007121025B2

(12) United States Patent
Weinstein

(10) Patent No.: US 7,121,025 B2
(45) Date of Patent: Oct. 17, 2006

(54) PROMOTIONAL DISPLAY WITH LIQUID INTERACTIONS

(76) Inventor: Marc Chase Weinstein, 740 Bryant Ave., Roslyn Harbor, NY (US) 11576

( * ) Notice: Subject to any disclaimer, the term of this patent is extended or adjusted under 35 U.S.C. 154(b) by 0 days.

(21) Appl. No.: 11/237,500

(22) Filed: Sep. 28, 2005

(65) Prior Publication Data

US 2006/0064908 A1 Mar. 30, 2006

Related U.S. Application Data

(60) Provisional application No. 60/613,212, filed on Sep. 28, 2004.

(51) Int. Cl.
*G09F 19/00* (2006.01)

(52) U.S. Cl. ..... 40/406; 40/409

(58) Field of Classification Search ..... 40/406, 40/409; 273/457; D11/131; 239/211, 16, 239/17; 446/166

See application file for complete search history.

(56) References Cited

U.S. PATENT DOCUMENTS

| | | | | |
|---|---|---|---|---|
| 3,564,740 | A * | 2/1971 | Calfee | 40/406 |
| 4,006,902 | A * | 2/1977 | Khawand | 273/113 |
| 4,034,493 | A * | 7/1977 | Ball | 40/406 |
| D248,632 | S * | 7/1978 | Gillespie et al. | D11/131 |
| D393,815 | S * | 4/1998 | Johnson et al. | D11/131 |
| 6,311,898 | B1 | 11/2001 | Gruff | |
| 6,594,929 | B1 * | 7/2003 | Butcher | 40/406 |

FOREIGN PATENT DOCUMENTS

| | | |
|---|---|---|
| WO | WO 90/03636 | 4/1990 |

* cited by examiner

*Primary Examiner*—Cassandra Davis
(74) *Attorney, Agent, or Firm*—Lawrence C. Edelman, Esq.

(57) ABSTRACT

A promotional display comprising a chamber having front and rear panels with inside and outside surfaces, for containing between expanses of the inside surfaces of the panels a first liquid. At least a portion of the outside surface of the front panel comprises a view surface which allows viewing of liquid flow inside the chamber. A liquid reservoir is positioned adjacent the chamber for containing a second liquid therein, which second liquid contrasts with and is not miscible with the first liquid. A restricted liquid flow path is located between the chamber and the reservoir, which allows flow of the second liquid into the chamber and across at least a portion of the view surface of the chamber. The chamber includes at least one recess formed in the outside of the front panel which extends the inside of the front panel substantially all the way to the inside surface of the back panel, so as to substantially cause any liquid which flows between the front and rear panels of the chamber in the area of the recess to flow around, rather than behind, the recess. An object, to which it is desired to attract the attention of a viewer of the display, is placed in the recess.

7 Claims, 4 Drawing Sheets

PROMOTIONAL DISPLAY WITH LIQUID INTERACTIONS

CROSS-REFERENCE TO RELATED APPLICATIONS

This application claims priority under 35 USC 120 of U.S. Provisional Patent Application U.S. Ser. No. 60/613,212, filed Sep. 28, 2004, entitled "Liquid Display With Embedded Interacting Objects. The entire disclosure of this patent application is incorporated herein by reference in its entirety.

BACKGROUND OF THE INVENTION

1. Field of the Invention

The present invention relates to promotional display device including a liquid component, and more particularly to embedding an object in the display in a manner so that it interacts with the liquid component, thereby drawing ones attention to and promoting the object having the liquid interactions.

2. Background Information and Description of the Related Art

Liquid displays for use in toys, signs and other novelties, for example, have been in use for years. Typical prior art liquid displays merely provide an interesting liquid background for drawing the eye of a viewer to the display, such as by having two liquids of different densities and color in one chamber, but usually there is no special effect to more particularly attract the viewers attention, such as to a particular portion of the display. PCT publication WO 90/03636 discloses a display sign that has a liquid flow surface as the inner side of a viewing panel, which viewing panel forms the front face of a sealed liquid reservoir. Due to irregularities on the inner surface of the viewing panel, the flow path of the liquid along the inner face is caused to have corresponding irregularities, which flow path irregularities attract a viewers attention.

It would be desirable to improve upon this concept to further increase the attention of the viewer to the display device, as well as to find a way of making the display more adaptable to providing different shapes/objects to which the attention of the viewer is directed. A more adaptable display would allow the display portion to be manufactured in a greater volume in order to reduce cost, yet still provide for customization of the final device.

SUMMARY OF THE INVENTION

In accordance with one aspect of the present invention, a promotional display comprises:

a chamber formed by spaced-apart front and rear panels, the panels having inside and outside surfaces for containing between an expanse of the inside surfaces of said panels a first liquid, at least a portion of the outside surface of said front panel comprising a view surface which allows viewing of liquid flow inside the chamber;

a reservoir positioned adjacent said chamber for containing a second liquid (including, for example, a flowable material) therein, which second liquid contrasts with and is not miscible with said first liquid;

a liquid flow path fluidly coupled between said chamber and said reservoir, for allowing flow of said second liquid into said chamber and across at least a portion of said view surface of said chamber;

wherein said chamber includes at least one recess formed in the outside of the front panel which extends the inside of the front panel substantially all the way to the inside surface of the back panel, so as to substantially cause any liquid. which flows between the front and rear panel of the planar chamber in the area of the recess to flow around, rather than behind, the recess; and wherein an object, to which it is desired to attract the attention of a viewer of the display, is placed in the recess.

In one embodiment of the present invention, the chamber is planar and formed of transparent rectangular walls which contain a clear liquid, and a reservoir is fluidly connected at opposed ends of the planar chamber and contains a differently colored liquid of different density than the liquid in the planar chamber. Thus, when the chamber is held vertically, any liquid in the top reservoir flows across the expanse of the chamber towards the bottom reservoir (or vice versa, depending on the relative densities of the two different liquids), and when the chamber is inverted so that that bottom reservoir is now at the top, the liquid flow from the top to the bottom (or vice versa) is repeated. The fluid connection preferably directs the flow from the reservoir into the chamber at particular places so as to cause a somewhat linear/meandering stream of the reservoir liquid as it travels across the expanse of the chamber, and more particularly, the stream is aligned with the at least one recess. With this arrangement, when the stream of reservoir liquid meets the recess, its linearity is disrupted, and it is caused to flow around, rather than through, the embedded object, thereby attracting the attention of the viewer to the embedded object.

BRIEF DESCRIPTION OF THE DRAWINGS

The accompanying drawings, which are incorporated herein and constitute part of this specification, illustrate embodiments and details of the invention, and, together with the general description given above and the detailed description given below, serve to explain the features of the invention.

DETAILED DESCRIPTION OF THE INVENTION

Figure 1A:
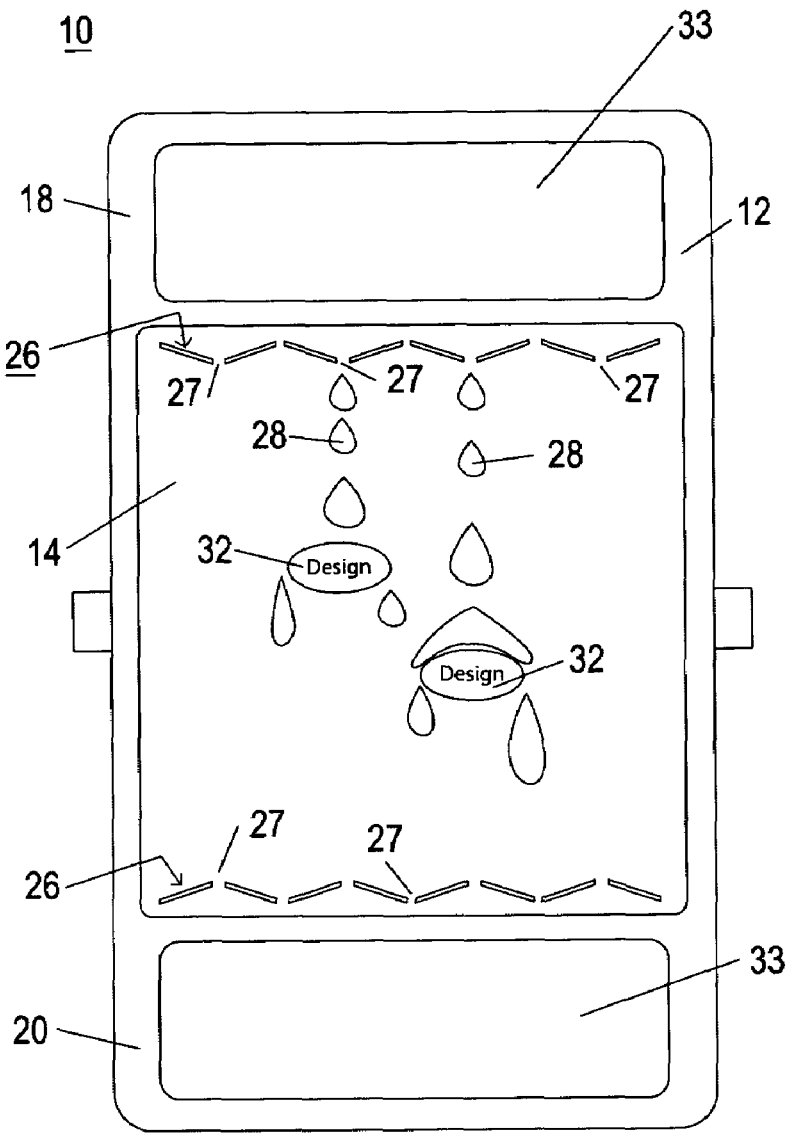
FIGS. 1*a* and 1*b* illustrate a front and side view, respectively, one embodiment of a promotional display device, constructed and operating in accordance with the principles of the present invention.
Figure 1B:
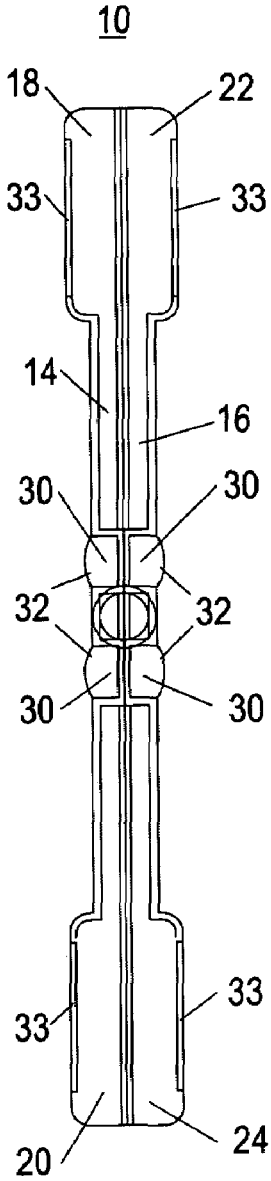

FIGS. 1*a* and 1*b* illustrate front and side views, respectively, of a preferred embodiment of a promotional device 10. In the illustrated embodiment, device 10 consists of a housing 12 having back-to-back rectangular liquid-holding chambers 14 and 16 for holding a first-type liquid therein, each chamber being formed of, for example, by substantially planar spaced-apart front and rear panels of a transparent material, such as plastic. Each chamber 14, 16 have mounted adjacent opposed ends thereof, a reservoir 18, 20 and 22, 24, respectively, in fluid connection with its respective liquid chamber 14, 16 positioned therebetween. Reservoirs 18, 20 and 22, 24 typically contain a flowable material therein, such as a second-type liquid that contrasts with the first-type liquid, such as a liquid or flowable material having a different color and a different density, so as to allow the second-type liquid to flow through the first type liquid of chambers 14, 16 in a separate and distinct manner, without mixing or losing its identity. Hereinafter, the term liquid is intended to include a flowable solid material, such as sand or beads.

In one embodiment of the invention, the first-type liquid is clear, such as a clear oil, and the second-type liquid in the reservoirs are the same, but a different color than the first-type liquid in chambers 14, 16. For example, the second-type liquid could comprise a blue colored water. In another embodiment, not only are the liquids in the reservoirs a different color from the liquids in the chambers, but the color of the liquid in reservoirs 18, 20 is different from the color of the liquid in reservoirs 22, 24.

The flow of liquids between the planar chambers 14, 16 and the respective reservoirs 18, 20 and 22, 24 at the opposed ends thereof, is controlled by a porous divider positioned therebetween, and the density of the first and second type liquids. In the illustrated embodiment the porous divider 26 is comprised of a string of "vee-shaped" walls positioned between the front and back panels of the chambers 14, 16 so as to block the flow of liquids between the chambers and their respective reservoirs, except at points between each "vee" of divider 26 where there are openings 27 of sufficient size to let the fluid in the reservoir flow out of the reservoir by a metered amount and thereby form a stream 28 of colored drops that flow through the clear liquid of the planar chambers 14, 16.

Thus, when the display 10 is held in a vertical position, the more dense and colored liquid in the reservoir is urged by the force of gravity to flow through the openings 27 so that the stream 28 of colored drops flow across the inside face of chamber 14 in a generally downward manner from reservoirs 18, 22 toward reservoirs 20, 24. In an alternative embodiment, the colored liquid in the reservoir may be less dense than the liquid in the chambers 14, 16, in which case stream 28 of colored drops flow across the inside face of chamber 14 in a generally upward manner from reservoirs 20, 24 toward reservoirs 18, 22.

It should be noted that although the illustrated embodiment shows two chambers 14, 16 and their associated reservoirs, in a more simple embodiment of the invention, on one chamber and reservoir would be needed, such as chamber 14 and reservoir 18.

In accordance with the principles of the invention, at least one recess 30 is formed in the front face of at least chamber 14 (but preferably similar recesses would be formed in chamber 16) which recess extends the inside of a front panel of chamber 14 substantially all the way to the inside surface of the back panel of chamber 14, so as to substantially cause any liquid which flows between the front and rear panels in the area of the recess to flow around, rather than behind, the recess. In the illustrated embodiment, two of such recesses 30 are shown in chamber 14 and in chamber 16. More or less recesses 30 could be used as desired.

In a preferred embodiment of the invention, the recesses 30 are positioned to be in the flow path of the streams 28, so that when the display 10 is held in a vertical position, the streams 28 flow directly into and are disturbed by the recesses 30, thereby drawing the attention of a viewer of the display, to the disruption of the stream. Consequently, the recess 30 becomes an ideal place to position a graphic, logo, image, further device, etc. for advertising and/or promotion.

Accordingly, in accordance with another aspect of the invention, a 2-dimensional or 3-dimensional (i.e., 2-D or 3-D) object 32 for which it is desired to attract a viewer's attention, is placed in the recesses 30.

Figure 2B:
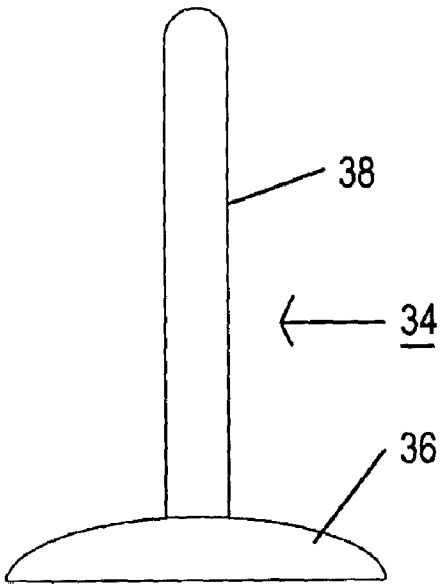
FIGS. 2*a* and 2*b* illustrate a front and side view, respectively, of one embodiment of a stand for the promotional display device of FIGS. 1 and 2, FIGS. 3*a*, 3*b* and 3*c* illustrate front, side and perspective views, respectively, of one embodiment of an object constructed in accordance with the principles of the present invention, for use in the recess of a promotional device of FIG. 1.
Figure 2A:
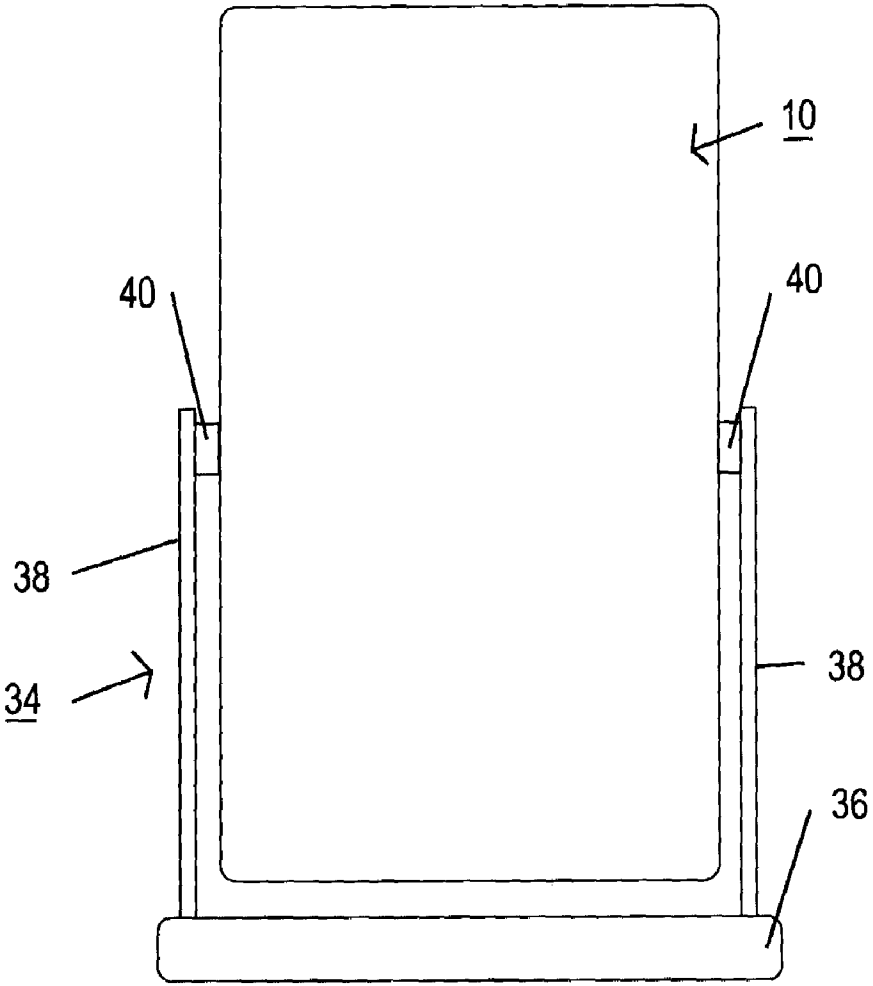

Before further discussion is provided for various embodiments of the object 32, the attention of the reader is directed to FIGS. 2*a* and 2*b*, which illustrate a convenient mechanism 34 for holding device 10. Mechanism 34 basically comprises a stand 34 having a base 36 adapted for being placed on a flat surface, such as a desk. The base 36 includes opposed supports 38 that extend upward in a vertical manner from the base 36. Supports 38 each include near the top portion thereof a pivot mechanism 40 which connects the device 10 to the supports in a manner that allows for device 10 to rotate about it's center and in doing so allow a user of the display device 10 to alternately place either of reservoirs 18 and 22 on the top or reservoirs 20 and 24 on the top.

Since in the illustrated embodiment chambers 14, 16 are positioned back to back, with this type of mounting for device 10, one can alternately cause the more dense liquid in the top reservoirs to flow to the bottom reservoirs, and in doing so, repeatedly create the streams 28 which draw the viewers' attention to the objects 32 by merely rotating device 10 180 degrees using mechanism 34.

In accordance with a further aspect of the invention, a graphic 33, such as a portion of a calendar, can be positioned, using e.g., an adhesive, on the opposed top ends of both the front and back sides of the device 10, so as to not only mask the presence of the reservoirs, but also provide a further use for device 10. More specifically, each graphic 33 could include a three-month portion of a calendar year, so that by viewing all four graphics 33, one can view all the days in the calendar year. Of course, in further embodiments of the invention, other types of uses and/or graphics can be found for advantageously positioning over reservoirs 18–24.

Figure 3A:
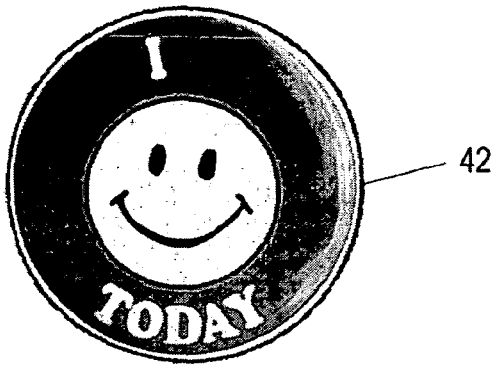
Figure 3B:
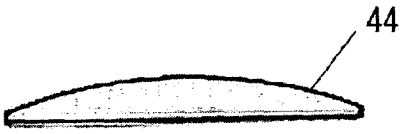
Figure 3C:
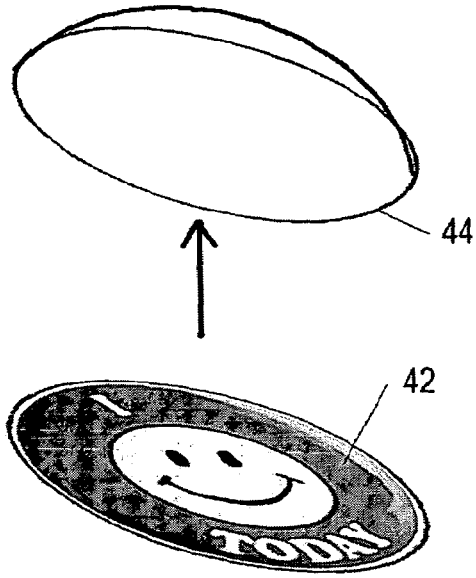
Figure 4:
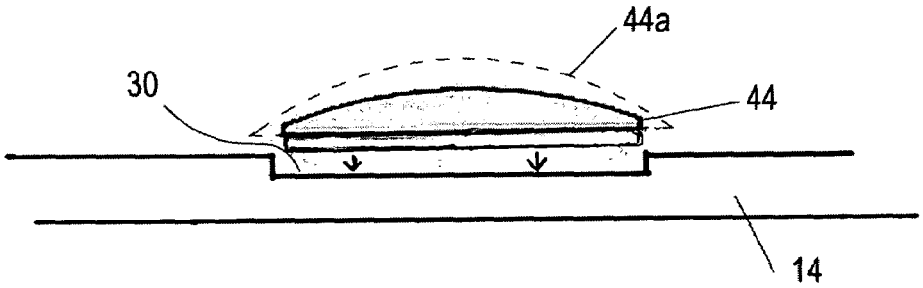
FIG. 4 illustrates a side view of the positioning of the object of FIG. 4 in the recess of the promotional device of FIG. 1, FIGS. 5*a*, 5*b* and 5*c* illustrate front, side and perspective views, respectively, of a further embodiment of an object constructed in accordance with the principles of the present invention, for use in the recess of a promotional device of FIG. 1.

FIGS. 3*a*, 3*b* and 3*c* illustrate front, side and perspective views, respectively, of one embodiment of an object 32 constructed in accordance with the principles of the present invention, for use in the recess 30 of the promotional device 10, while FIG. 4 illustrates a side view of the positioning of the object of FIG. 4 in the recess 30 of the promotional device 10. More specifically, FIG. 3 shows the use of a 2-D graphic image 42 which is adhered to the flat underside of a transparent epoxy dome 44. As shown by FIG. 4, the assembled object 42/44 is then placed in the recess 30, where the viewers' attention is directed to the object by the flowing/disrupted stream 28. With this arrangement, the graphic image 42 appears to be in the liquid, but actually is dry, thereby allowing a low-cost 4-color graphic image to be used. As shown by dashed lines in FIG. 4, a dome 44*a* could have an outer dimension, in this case an outer diameter, which is greater than the diameter of the recess 30, in order that viewing distortion caused by that portion of the outer edge of dome 44*a* that overlaps past the outer edges of the recess 30, serves to further enhance the viewers' experience and therefore attention. In an alternative embodiment, a 3-D graphic or object could be recessed, molded or otherwise positioned into the underside of dome 44. In one embodiment, the recess could have a 1 to 1.5 inch diameter, and in a further alternative embodiment, graphic 42 would be used without dome 44.

Figure 5A:
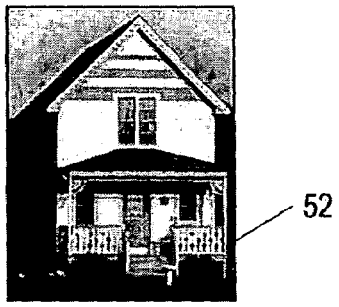
Figure 5C:
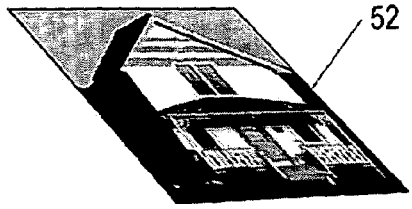
Figure 5B:
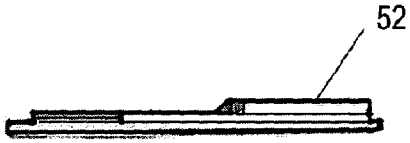
Figure 6:
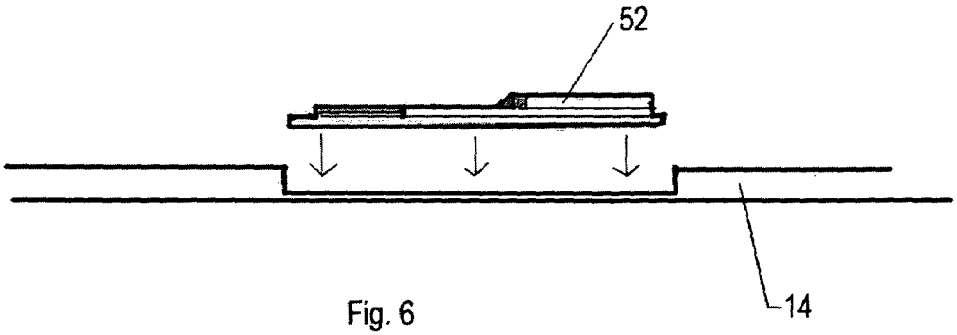
FIG. 6 illustrates a side view of the positioning of the object of FIG. 5 in the recess of the promotional device of FIG. 1.

FIGS. 5*a,* 5*b* and 5*c* illustrate front, side and perspective views, respectively, of a further embodiment of an object 32 constructed in accordance with the principles of the present invention, for use in the recess 30 of a promotional device 10, while FIG. 6 illustrates a side view of the positioning of the object of FIG. 5 in the recess 30 of the promotional device 10. More specifically, FIG. 5 shows the use of a 3-D relief of a scene, such as a house 52, as the object 10. FIG. 6 shows the assembled object 52 being placed in the recess 30, where the viewers' attention is directed to the object by the flowing/disrupted stream 28.

While the present invention has been disclosed with reference to certain embodiments, numerous modifications, alterations and changes to the described embodiments are possible without departing from the sphere and scope of the present invention, as defined above, and in the following claims. For example, although in the illustrated embodiments two back to back chambers 14, 16 are shown, only one chamber could be used, and although the chambers are shown to be substantially planar, other shapes could be appropriate, such as curved. Additionally, although in the illustrated embodiments only two recesses 30 are shown on each of chambers 14, 16, more or less recesses could be used, and they could be aligned with recess on the reverse side of device 10, or not so aligned. Even furthermore, although in the illustrated embodiments objects having substantially the same shape as the recesses 30 are used, objects having a shape different than the recess can be used. In an even further alternative embodiment, instead of using a colored liquid in the reservoirs 18–24, a "fluid" solid material, such as sand or colored beads, could be used to form the "stream of drops 28". Accordingly, it is intended that the present invention not be limited to the described embodiments, but that it has the fall scope defined by the above language and the following claims, as well as equivalents thereof.

The invention claimed is:

1. A promotional display, comprising a chamber formed by spaced-apart front and rear panels, the panels having inside and outside surfaces for containing between an expanse of the inside surfaces of said panels a first liquid, at least a portion of the outside surface of said front panel comprising a view surface which allows viewing of liquid flow inside the chamber;

a reservoir positioned adjacent said chamber for containing a second liquid therein, which second liquid contrasts with and is not miscible with said first liquid;

a restricted liquid flow path located between said chamber and said liquid reservoir, for allowing flow of said second liquid into said chamber and across at least a portion of said view surface of said chamber;

wherein said chamber includes at least one recess formed in the view surface of the front panel, which recess extends the inside of the front panel substantially all the way to the inside surface of the back panel, so as to substantially cause any liquid which flows between the front and rear panel of the chamber in the area of the recess to flow around, rather than behind, the recess; and wherein an object, to which it is desired to attract the attention of a viewer of the display, is placed in the recess.

2. The display of claim 1, wherein said restricted liquid flow path creates a stream type of flow of said second type liquid into said chamber.

3. The display of claim 2, wherein a 3-D object is located in said recess.

4. The display of claim 3, where said recess is positioned in said chamber so as to be in the flow path of said stream.

5. The display of claim 2, wherein said recess is positioned in said chamber at a location in the view surface which is substantially in the flow path of said stream.

6. The display of claim 1, wherein a 2-D object is located in said recess.

7. The display of claim 6, where said recess is positioned in said chamber so as to be in the flow path of said stream.

* * * * *